US005488467A

United States Patent [19]

Marentes et al.

[11] Patent Number: 5,488,467

[45] Date of Patent: Jan. 30, 1996

[54] LASER PRINTER PAPER HANDLING SYSTEM

[75] Inventors: Faustin T. Marentes, Montebello; Jorge Monasterio, Lake Forest, both of Calif.

[73] Assignee: RJS, Inc., Monrovia, Calif.

[21] Appl. No.: 265,232

[22] Filed: Jun. 24, 1994

[51] Int. Cl.[6] ..... G03G 15/20

[52] U.S. Cl. ..... 355/282; 271/273; 271/902; 347/139; 355/290; 355/295; 355/309; 355/317

[58] Field of Search ..... 355/282, 285, 355/290, 295, 309, 271, 316, 321, 317; 219/216; 347/139; 226/174, 110, 187, 195, 196, 199, 74, 24, 28; 358/498; 400/616.2, 608.2, 641, 578; 271/273, 50, 902

[56] References Cited

U.S. PATENT DOCUMENTS

| | | | |
|---|---|---|---|
| 698,125 | 4/1902 | Messter | 226/196 X |
| 890,372 | 6/1908 | Orr | 400/633 |
| 1,100,801 | 6/1914 | Wendell | 226/196 X |
| 1,455,454 | 5/1923 | Smith | 400/610.4 |
| 1,484,218 | 2/1924 | Hilsee | 400/599.1 |
| 1,537,710 | 5/1925 | Smith | 400/599.1 |
| 1,743,859 | 1/1930 | Kupetz | 400/599.1 |
| 2,015,728 | 10/1935 | Resch | 400/623 |
| 2,616,690 | 11/1952 | Haringx | 226/195 |
| 2,974,952 | 3/1961 | Zeuthen | 271/242 |
| 2,988,356 | 6/1961 | Maier | 271/10.04 |
| 3,061,303 | 10/1962 | Glaser et al. | 271/171 |
| 3,241,665 | 3/1966 | Erk | 271/273 X |
| 3,298,682 | 1/1967 | Gatti | 271/10.12 |
| 3,411,768 | 11/1968 | Gatti | 271/10.09 |
| 3,494,527 | 2/1970 | Bauer et al. | 226/88 |
| 3,532,338 | 10/1970 | Brinson et al. | 271/246 |
| 3,794,230 | 2/1974 | Bryan et al. | 226/3 |
| 3,850,355 | 11/1974 | Downie et al. | 226/110 |
| 4,019,025 | 4/1977 | Taniguchi et al. | 271/273 X |
| 4,297,716 | 10/1981 | Hirayama et al. | 347/139 |
| 4,542,414 | 9/1985 | Nagane | 271/272 X |
| 4,650,358 | 3/1987 | Lohrmann et al. | 400/616.2 |
| 4,925,079 | 5/1990 | Castiglioni | 226/152 |
| 5,017,970 | 5/1991 | Sakata | 355/290 |
| 5,023,667 | 6/1991 | Negoro et al. | 355/274 |
| 5,087,947 | 2/1992 | Torino | 355/290 |
| 5,168,290 | 12/1992 | Tanaka et al. | 355/309 X |
| 5,181,076 | 1/1993 | Nishikawa | 355/315 |
| 5,181,104 | 1/1993 | Sugishima et al. | 358/500 |
| 5,231,457 | 7/1993 | Nakano et al. | 355/271 X |
| 5,432,593 | 7/1995 | Nishikawa et al. | 355/282 X |

FOREIGN PATENT DOCUMENTS

| | | | |
|---|---|---|---|
| 61-90167 | 5/1986 | Japan | 355/295 |
| 61-184573 | 8/1986 | Japan | 355/282 |

*Primary Examiner*—A. T. Grimley
*Assistant Examiner*—Shuk Y. Lee
*Attorney, Agent, or Firm*—Christie, Parker & Hale

[57] ABSTRACT

A laser printer paper handling system employing separately controllable traction rollers having a registration roller and a fuser pressure roller which are separable from their associated pressure roller and fuser roller respectively, to allow separate engagement of the print paper during a print cycle. The registration roller engages its associated pressure roller and frictionally feeds the paper past a photoconductive drum. As the leading edge of the paper approaches, the fuser roller is engaged by the fuser pressure roller and the registration roller is disengaged causing the paper to be frictionally fed exclusively by the fuser roller. Operation of the rocker arm supporting the registration roller and the carrier bracket for the fuser pressure roller, as well as a paper platen which carries a standard corona transfer unit for activating the photoconducting drum, through a multi-surface cam provides position control for the system elements.

4 Claims, 11 Drawing Sheets

LASER PRINTER PAPER HANDLING SYSTEM

BACKGROUND OF THE INVENTION

1. Field of the Invention

The present invention is drawn generally to the field of paper handing systems for printers having photostatic printing systems requiring heated fixing rollers for adhering copy print to the copy media. More particularly, the invention provides a multiple traction source system with individually controllable drive elements to preclude jamming, tearing or skewing of the paper or form while allowing reversible feed capability for reduction of printing media waste.

2. Prior Art

Conventional laser printing systems employ a photoconductive drum activated by a laser to transfer the image to be copied. A transfer unit cooperating with the photoconductive drum deposits toner onto the print medium which is then cured or otherwise affixed to the print medium by a heated fuser assembly. Paper feed systems typically employ a feed roller and idler pair which drives paper through the cooperating photoconductive drum and transfer unit and the fuser assembly is incorporated within a rotating fixing roller which cooperates with a second pressure roller. In typical printing systems to allow the use of cut sheet as the print medium both the feed roller and fixing roller are power driven. Cut sheet is frictionally fed by the feed roller between the drum and transfer unit to the fixing unit. As the sheet reaches the fixing unit it is then also frictionally fed by the fixing roller until the sheet exits the printer.

The prior art printing systems are unsatisfactory for feeding continuous forms in many applications. When a long length or continuous form is frictionally fed simultaneously by two or more rollers, the presence of manufacturing tolerances in the system frequently causes an accumulation of stresses on the form which results in jamming, tearing or skewing. In addition, the presence of a hot fixing roller precludes stopping the paper for any significant period of time due to the potential for scorching. With continuous forms, the sequential nature of the copying process which prints one "document" at a time, cause significant waste of the forms due to the requirement for the last printed form to exit the printer. Unless the paper is then reverse fed to realign the unprinted paper portion with the photoconducting drum, that amount of paper (or forms) is wasted. Normally in printing one document at a time without reverse feeding, wastage of 50% or greater may be present. If reverse feeding is incorporated, the multiple traction point difficulties discussed above are exacerbated.

SUMMARY OF THE INVENTION

The present invention eliminates the shortcomings of the prior art by employing separately controllable traction rollers separable from their associated pressure rollers as the registration roller and fixing roller. During a print cycle, the registration roller engages its associated pressure roller and frictionally feeds the paper past the photoconductive drum. As the leading edge of the paper approaches the fuser roller, the fuser roller is engaged with its associated pressure roller and immediately thereafter, the registration roller is disengaged causing the paper to be frictionally fed exclusively by the fuser roller. During any stopped or standby condition, the registration roller is engaged and in full control of the paper with the fuser roller disengaged to avoid scorching of the paper. Engagement and disengagement of the registration roller and fuser roller is triggered by a top-of-form sensor providing a position signal to a microprocessor controller which in turn controls a motor operated cam system for roller control.

For multiple document printing, the fuser roller continues to feed the paper until the batch printing run is complete. As the trailing edge of the last document passes the fixing roller, the registration roller engages, the paper stops moving and the fuser roller disengages. The paper is now again in full control of the registration roller, and upon starting the next print job, the registration roller reverse feeds the paper past the next top of form, stops, and then starts the print cycle with the top of form properly aligned. Paper wastage is thereby eliminated.

A preferred structural arrangement of the bidirectional paper feed mechanism comprises a registration roller mounted to a first rocker arm which rotates about a pivot point responsive to the position of a cam roller on a multiple contoured cam. A first pressure roller cooperates with the registration roller for frictional engagement of the paper. A paper platen is pivotally mounted for motion responsive to a second cam roller riding on a second path of the contoured cam. The paper platen urges the paper against a photoconductor for image transfer. A fuser assembly comprising a carrier bracket pivotally mounted for rotation responsive to a third cam roller following a third path on the contoured cam, carries the heated fuser roller which in combination with a second pressure roller provides frictional engagement for the paper sheet during fusing of the image by the fuser roller.

In operation, paper is initially fed through the mechanism with the registration roller in a first position engaging the first pressure roller to provide a friction drive moving the paper in either a forward or rearward direction. Transfer of the image to the paper by the photoconductor is accomplished with the paper moving in the forward direction with the platen in position to engage the paper against the photoconductor. During the photo transfer process, the fuser roller is brought into engagement with the paper and provides a frictional traction mechanism for drawing the paper through the system while the registration roller disengages and is placed in a second or open position to preclude paper misalignment or jamming due to multiple traction locations. Upon completion of the fusing of the image, the fuser assembly may act as a traction feed or be released for forward or rearward motion of the paper by the registration roller.

Elimination of multiple friction feed substantially precludes skewing of the print media even with reversible feed for paper conservation. Exclusive continuous control of paper feed at all times by either the registration roller or fuser roller, but not by both, provides a stress free condition in the paper to eliminate the skewing tendency. The present invention also incorporates a spring loaded guide which comprises a flat sheet metal plate having downwardly extending lips at the paper entry point and the paper exit point. A second sheet metal plate is attached to two brackets for pivotal rotation from a first open position for aligning paper on the paper guide to a second closed position wherein the second plate contacts the edge portion of the paper sheet. The second plate is formed with upwardly extending portions at each end of the plate which provide the attachment to the pivotally mounted brackets. The upwardly extending portion in combination with the material resiliency of the second plate result in a reaction of the second plate as a second leaf spring against the paper sheet providing a downward force on the edge portion of the sheet. A second spring arrangement identical to the first is present on the opposite side of the paper sheet, thereby providing a resilient downward pressure on both edge portions of the sheet. Use of the side guides maximizes the beam strength of the paper to provide further assurance against skewing.

DETAILED DESCRIPTION

Figure 1:
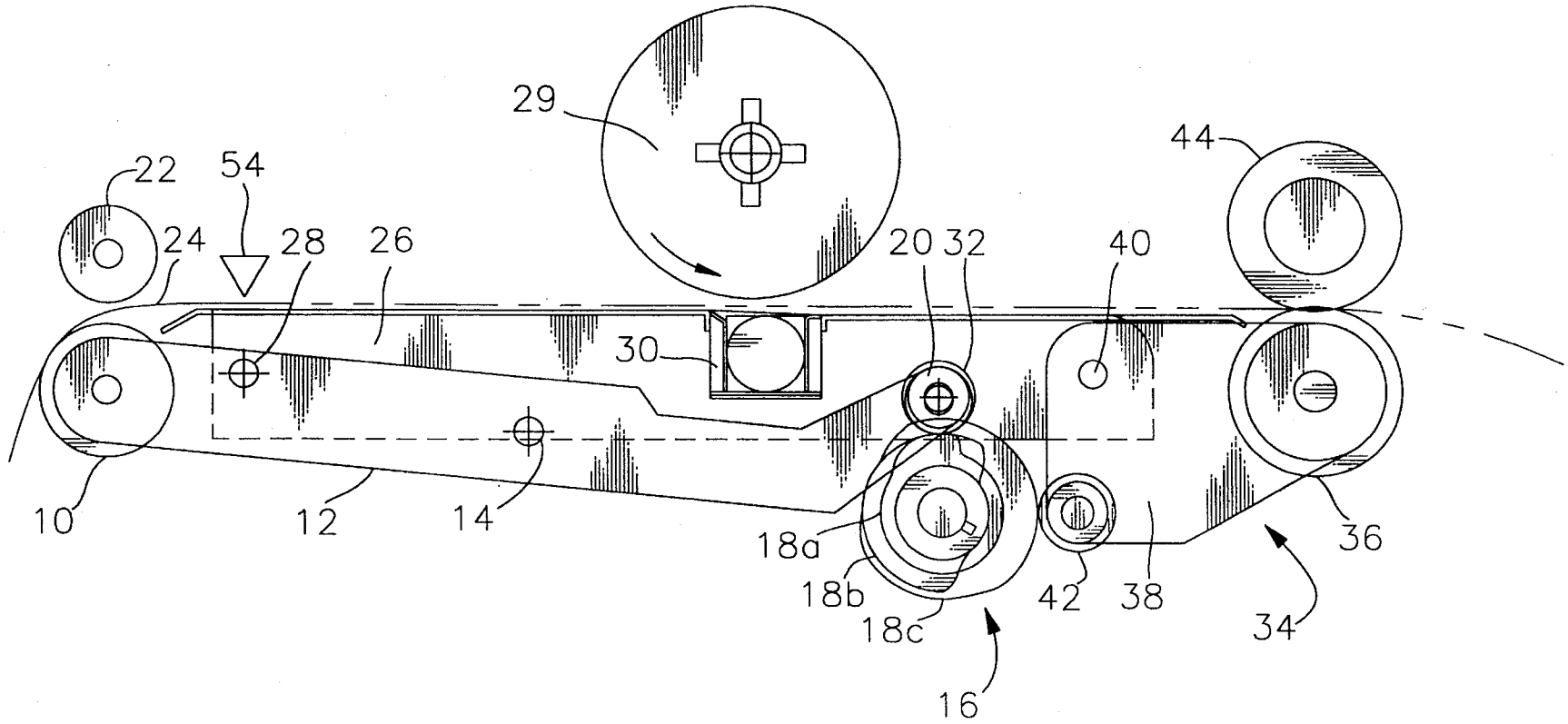
FIG. 1 is a side view of the mechanical elements of the present invention.

Referring to the drawings, FIG. 1 discloses the basic mechanical elements of the present invention. A registration roller 10 is mounted on rocker arm 12. The rocker arm pivots on pin 14. Position of the rocker arm and registration roller is controlled by a multi-surface cam 16 which incorporates a first contoured path 18 engaging a cam roller 20 mounted to the rocker arm opposite the pivot point from the registration roller. The registration roller is driven by a main motor (not shown) through a clutch arrangement.

The registration roller clutch engages and disengages the registration roller from the primary motor to allow transfer of traction on the paper media from the registration roller to the fuser roller, as will be described in greater detail subsequently.

The registration roller cooperates with a first pressure roller 22 which frictionally engages the registration roller in a first raised position. Positioning of the registration roller will be described in greater detail subsequently.

Copying media, whether continuous paper, cut sheet, forms, bifold or other perforated paper is fed through the print mechanism on paper path 24, shown in phantom. A paper platen 26 pivotally mounted at a first end on pin 28 supports the paper during the print transfer process. The platen extends under a photoconducting drum 29 mounted adjacent a standard corona transfer unit 30 which is incorporated within the paper platen. A second cam roller 32 attached to the paper platen determines the platen's position based on a second contoured path 18*b* on the cam.

A fuser assembly 34 includes the fuser pressure roller 36 which cooperates with the fuser roller 44 which is heated to affix the print toner applied by the transfer assembly to the media. The fuser pressure roller is mounted on a carrier bracket 38 which is pivotally mounted to the paper platen on pin 40 at the opposite end of the paper platen from its mounting point. A third cam roller 42, mounted to the carrier bracket rides on a third contoured path 18*c* of the cam for positioning of the fuser roller.

The fuser pressure roller 36 frictionally engages the fuser roller 44 in a first raised position to be described in greater detail subsequently. Rotation of the fuser roller for paper drive is accomplished by mechanical coupling to the main motor.

A cam motor positions the multi-contour path cam responsive to a controller to be described in greater detail subsequently.

Positioning of the various mechanical elements of the system during operation for one embodiment of the invention is best described with respect to FIGS. 2*a* through 2*h*, 3*a* through 3*g* and 4*a* through 4*g*.

Figure 2A:
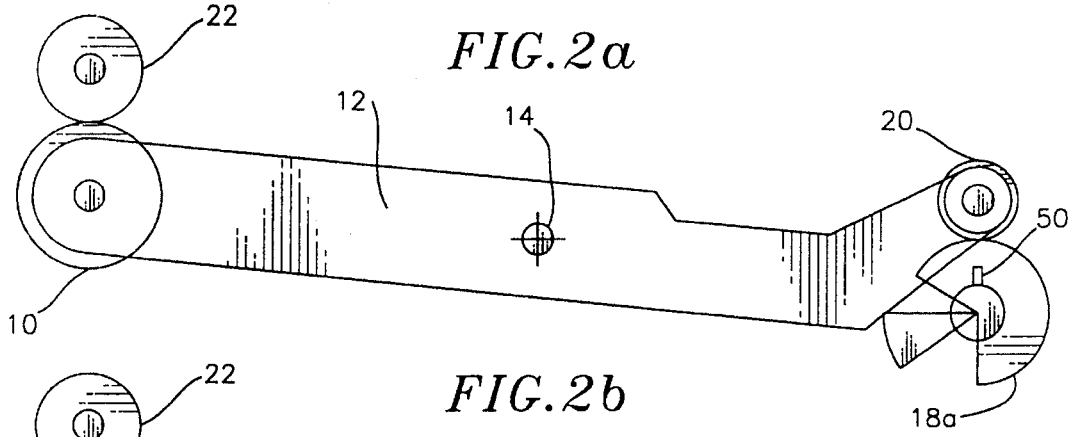
FIGS. 2*a*, 2*b*, 2*c*, 2*d*, 2*e*, 2*f*, 2*g*, and 2*h* demonstrate the positioning of the registration roller and its associated idler roller for various states of the printing mechanism.
Figure 3A:
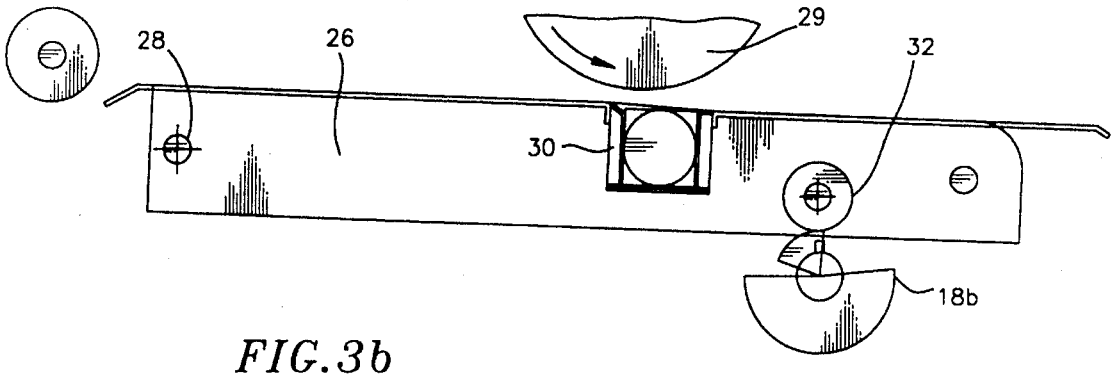
FIGS. 3*a*, 3*b*, 3*c*, 3*d*, 3*e*, 3*f*, and 3*g* demonstrate the positioning of the paper platen for various states of the drive mechanism.
Figure 4A:
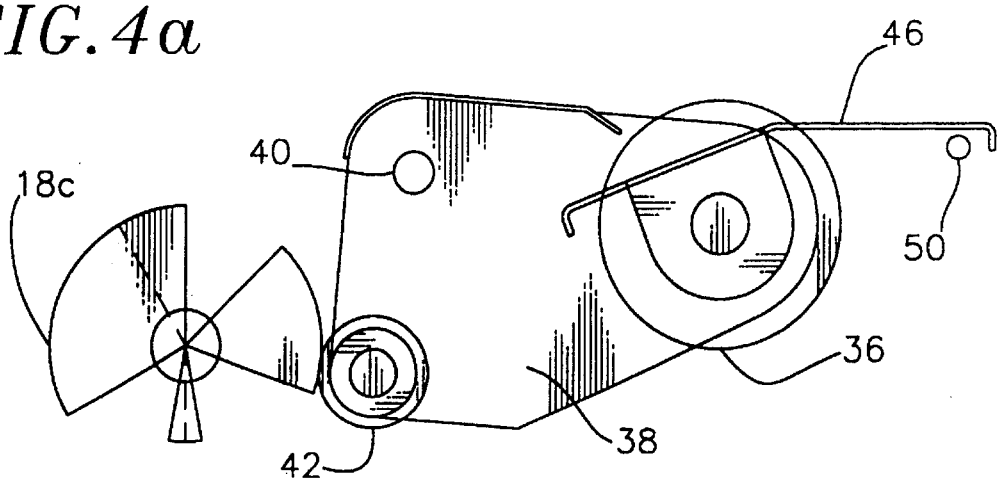
FIGS. 4*a*, 4*b*, 4*c*, 4*d*, 4*e*, 4*f*, and 4*g* demonstrate the positioning of the fuser roller for various states of the printing mechanism.

The first state of the mechanical elements of the system is shown in FIGS. 2*a*, 3*a* and 4*a*. In this state the cam is positioned at zero degrees as indicated by the cam reference tab 50. In this position the first contour of the cam 18*a* places the registration roller in the up position. The second contour 18*b* places the paper platen in a down or open position and the third contour 18*c* places the fuser carriage in a down or open position. In this state the registration roller is engaged with its associated pressure roller and provides traction feed for the copying media.

Figure 2B:
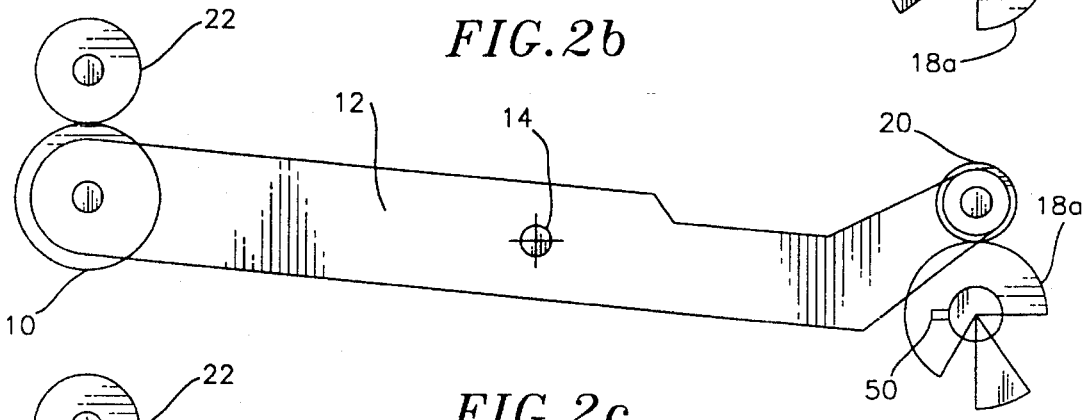
Figure 2C:
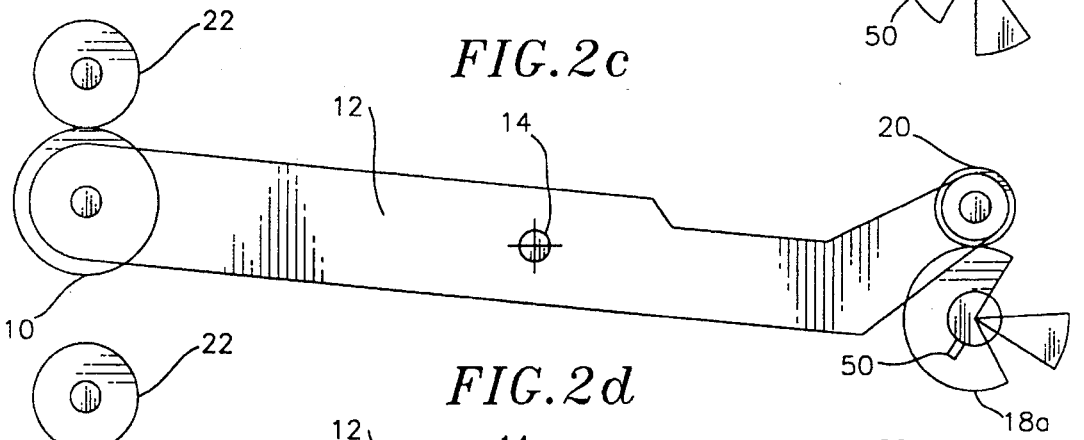
Figure 3B:
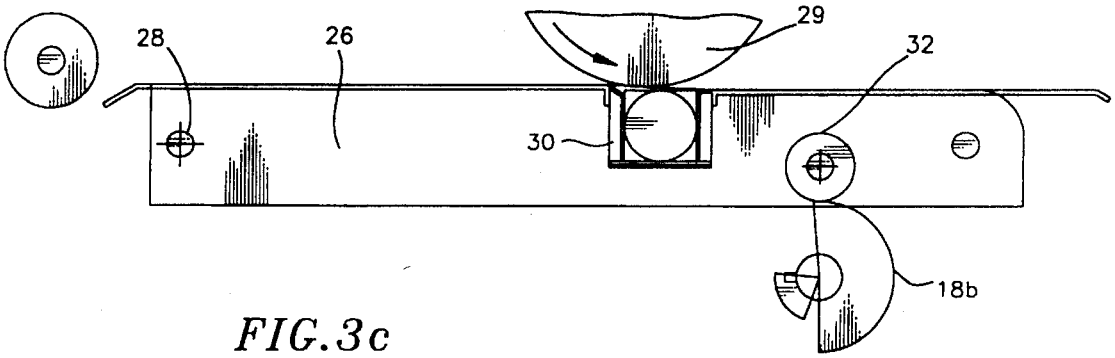
Figure 3C:
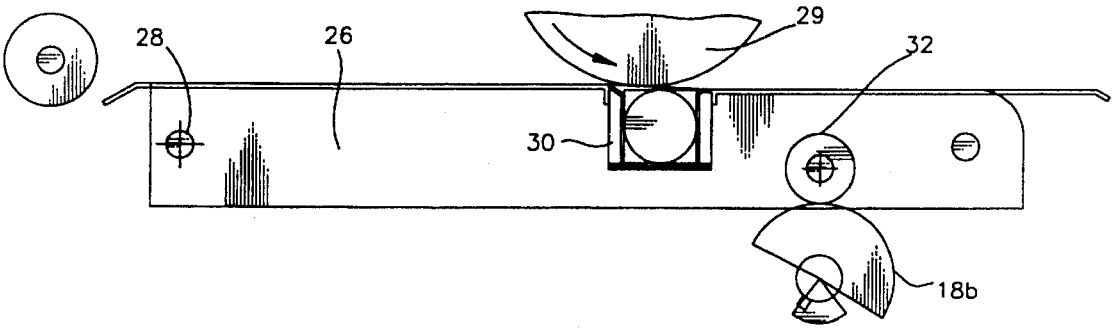
Figure 4B:
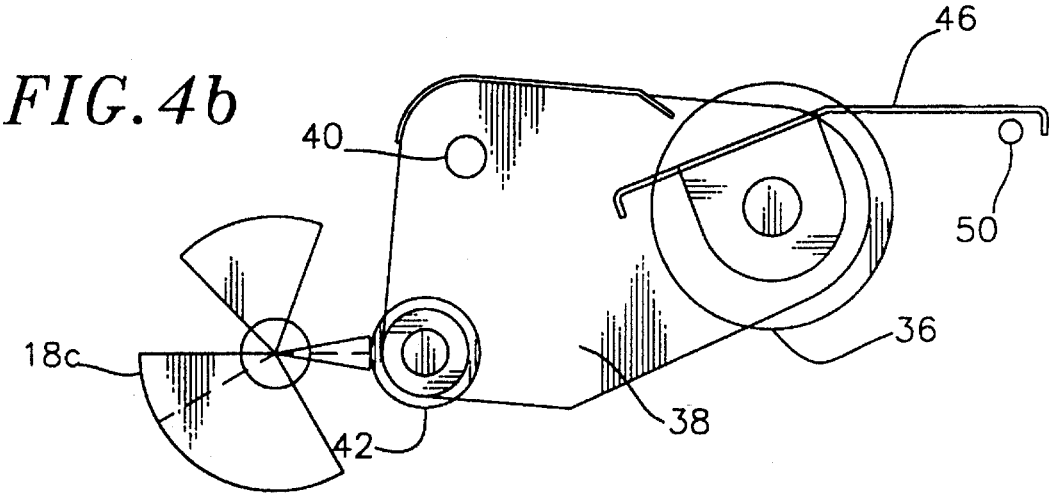
Figure 4C:
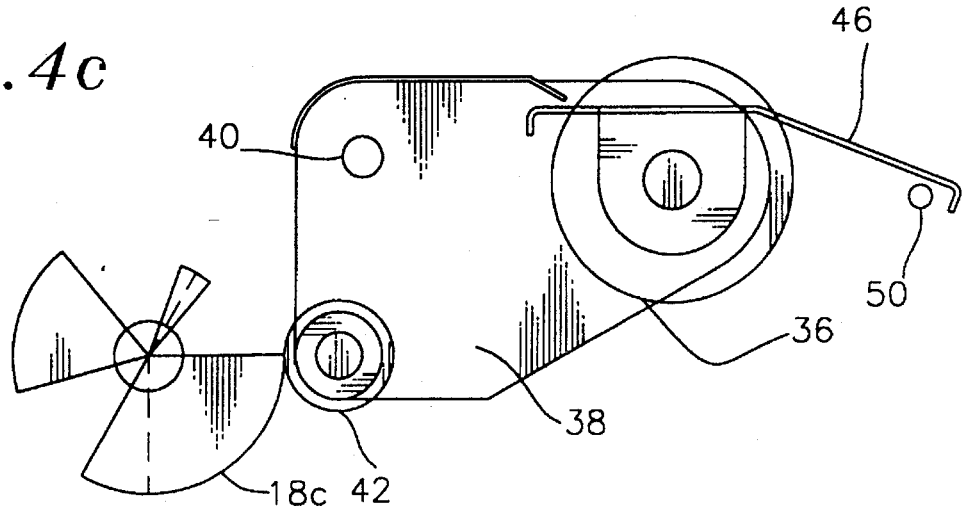

As the copying process is initiated, the cam is rotated 90 degrees to a second state which is shown in FIGS. 2*b*, 3*b* and 4*b*. At the 90 degree cam position, the registration roller remains in the up or closed position providing traction feed for the paper as seen in FIG. 2*b*. The paper platen is raised to engage the paper against the photoconductive drum and transfer assembly as shown in FIG. 3*b*. The fuser assembly, pivotally mounted to the paper platen on pin 40, is partially raised by closure of the paper platen, however, the third contour of the cam maintains the fuser pressure roller in a down or partially open position as show in FIG. 4*b*. During the copying process the cam is rotated from the 90 degree position through 50 degrees of rotation to the 148 degree position as shown in FIG. 2*c*, 3*c* and 4*c*. In this position the registration roller remains up or closed, the paper platen remains up and closed and the fuser assembly is raised to a closed position as shown in FIG. 4*c*. The up or closed position of the fuser allows toner transferred to the copy media to be fused by the heated fuser roller. In addition, in the closed position the fuser roller frictionally engages the copy media.

Figure 2D:
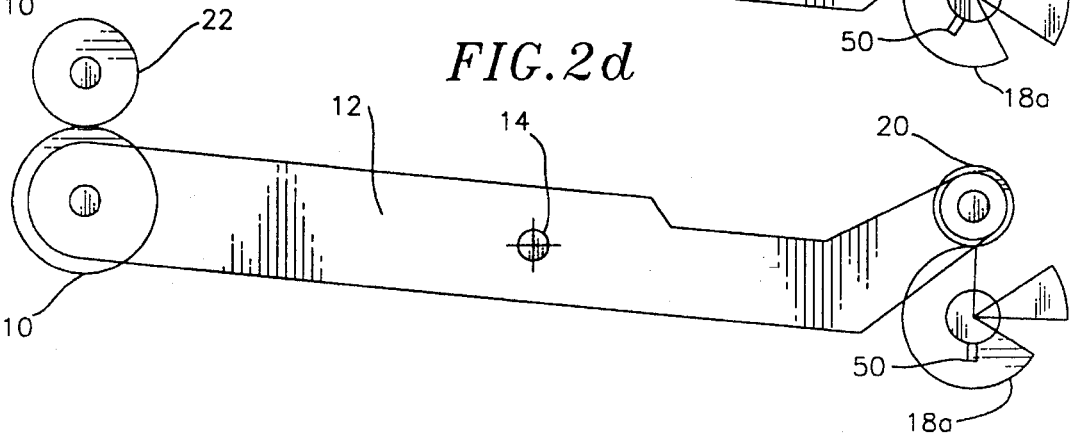
Figure 2E:
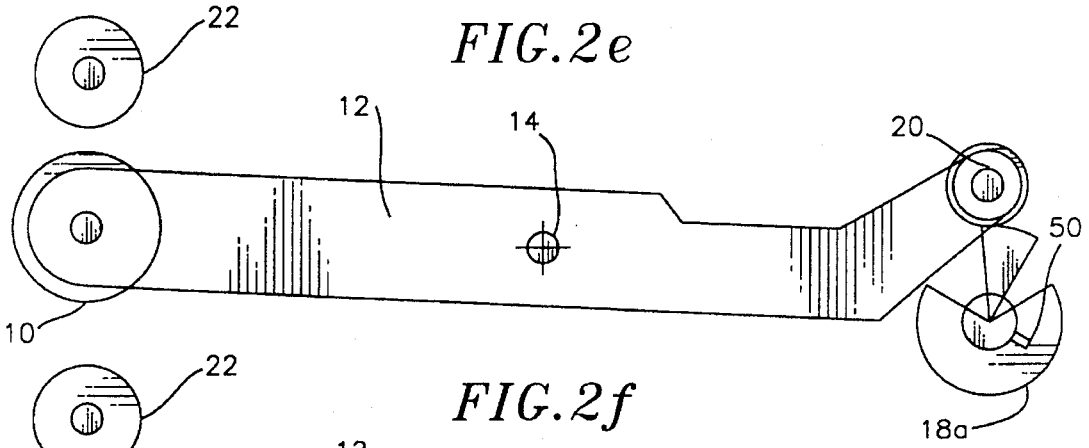
Figure 2F:
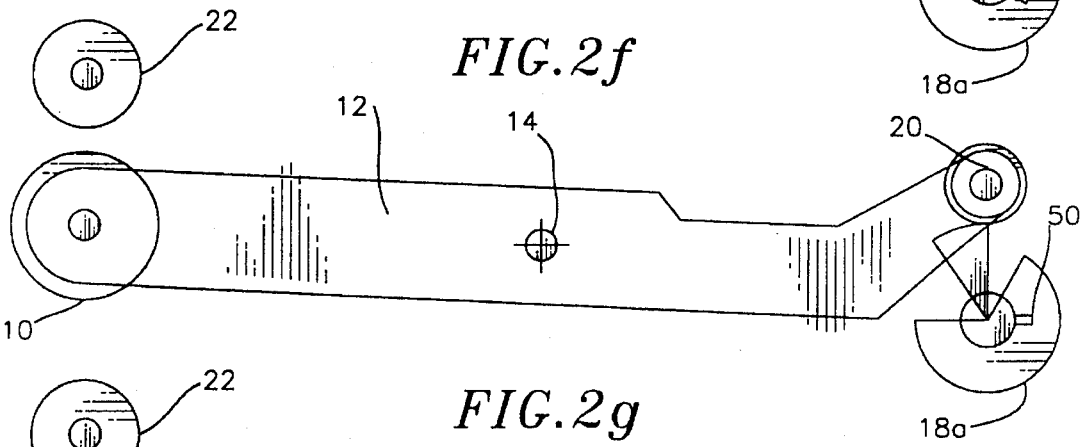
Figure 2G:
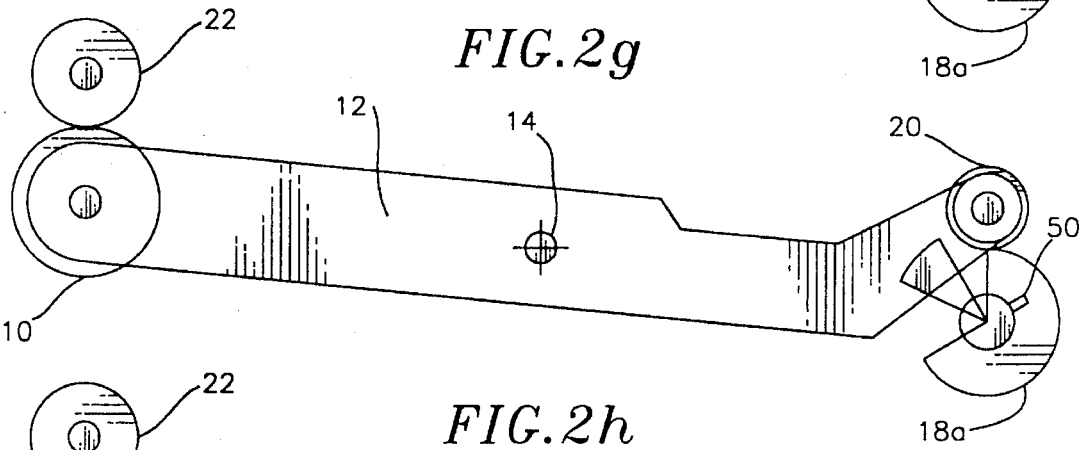
Figure 3D:
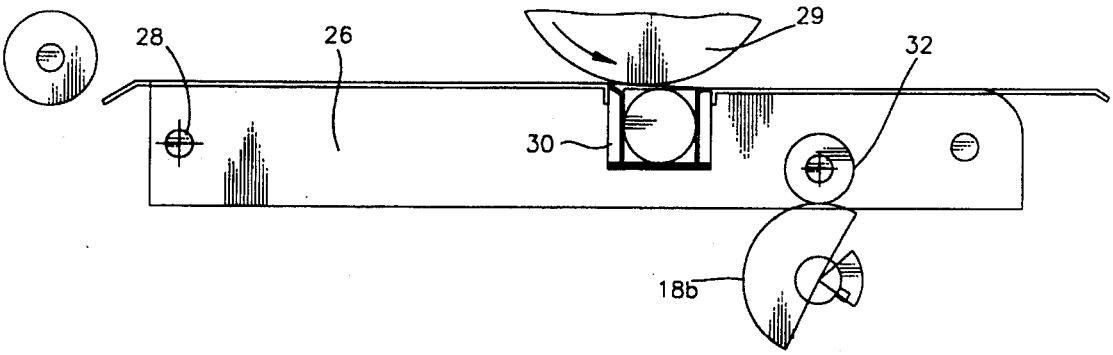
Figure 3E:
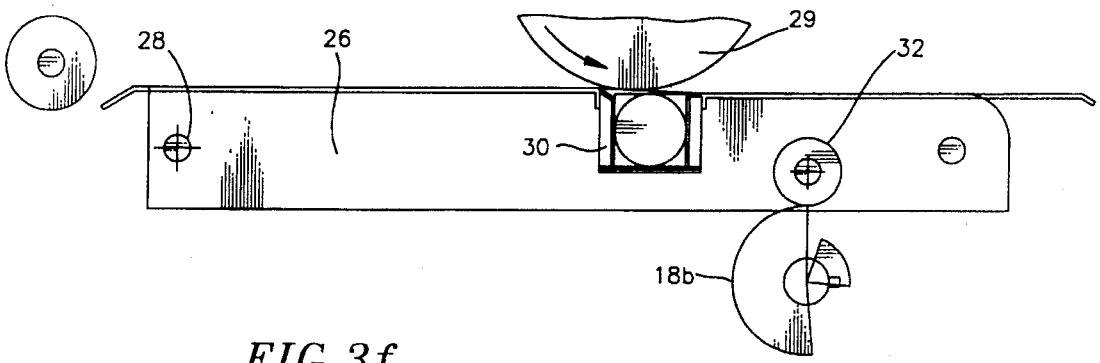
Figure 3F:
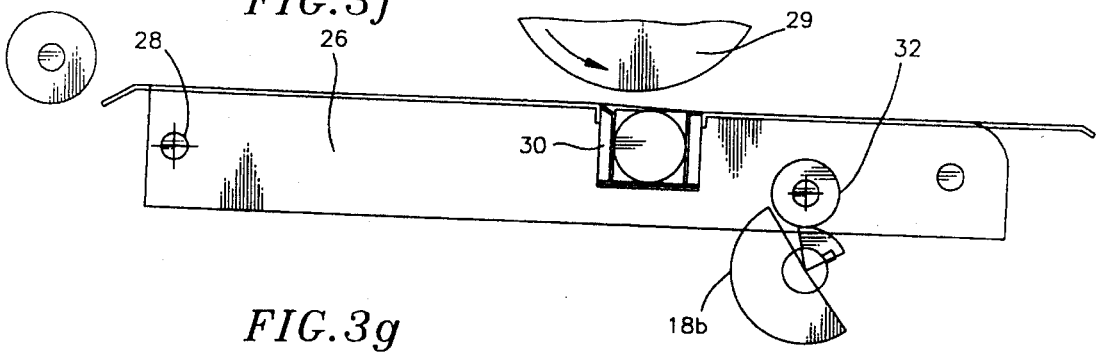
Figure 4D:
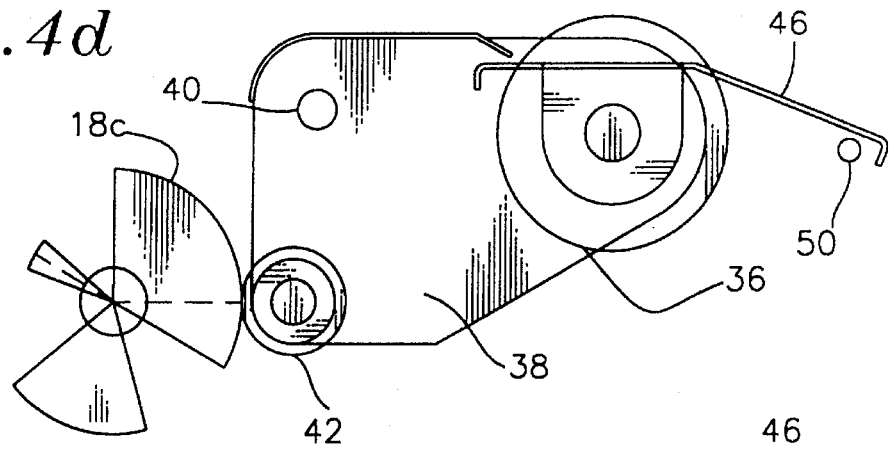
Figure 4E:
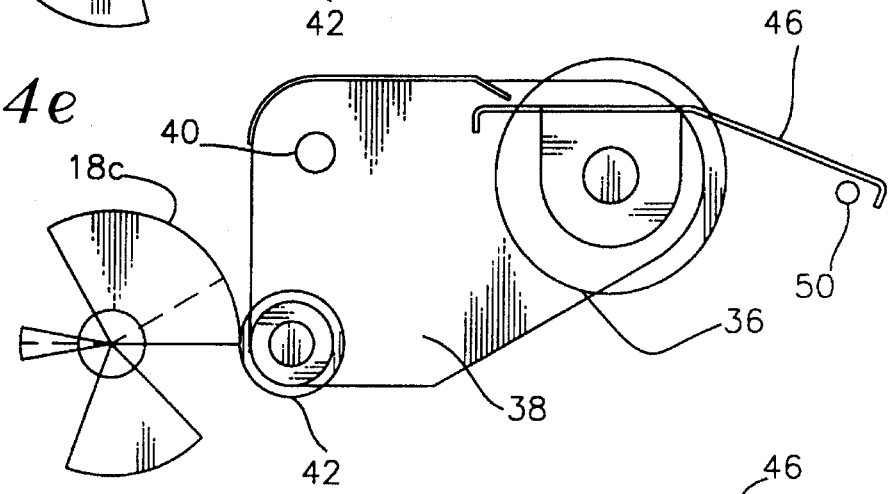
Figure 4F:
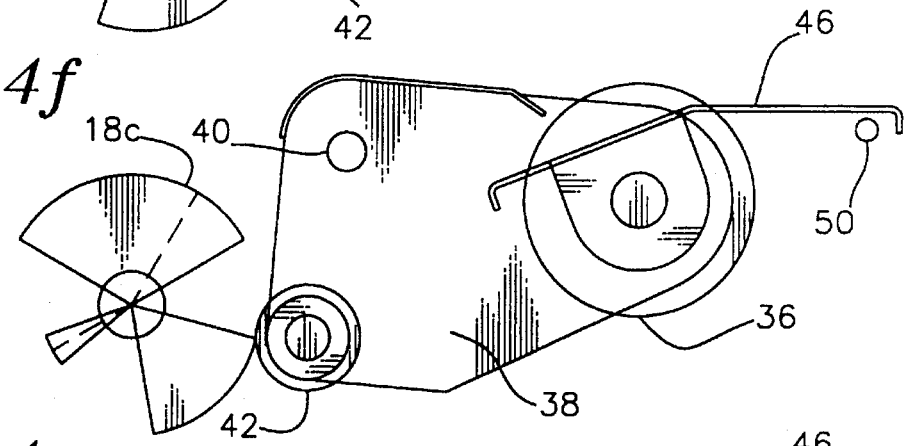

The cam continues rotation for an additional 30 degrees to the 178 degree position as shown in FIGS. 2*d* at which point the registration roller controlled by the first contour begins to open. An additional 60 degrees of cam rotation to the 240 degree position provides the state shown in FIGS. 2*e*, 3*d* and 4*d*. In this state the registration roller is open or down allowing the fuser roller to provide traction feed for the copy media as shown in FIG. 4*d*. The paper platen remains in the up position as shown in FIG. 3*d* for continued copying.

If multiple form or batch copying is in process the system remains in this state until copying is complete. Upon completion of copying or if a single form is being copies in a "on demand" mode, the cam rotates through 30 degrees to the 270 degree position shown in FIGS. 2*f*, 3*e* and 4*e* which ends the down position for the registration roller and begins closing the registration roller by raising it to the up position. Similarly, the fuser up position is ended and the fuser carriage assembly is moved into the down position. Similarly, the paper platen begins to open disengaging the copy media from the photoconductive drum. At 300 degrees of cam rotation the system arrives at the state shown in FIGS. 2*g*, 3*f* and 4*f* wherein the registration roller is up or closed engaging the paper for traction feed. The paper platen is open and the fuser carrier bracket is open or down. In this position, the main motor driving the registration roller is reversed to retract the print media to a top of form position to avoid paper wastage.

Figure 2H:
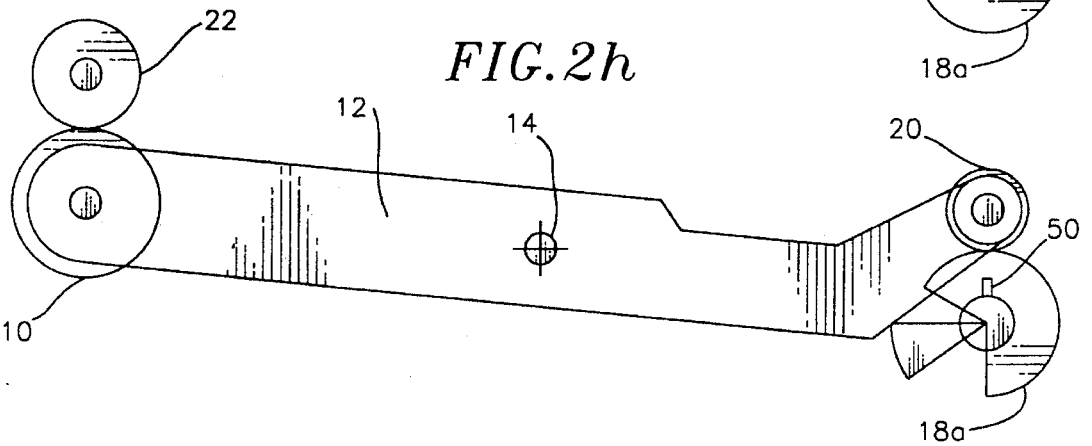
Figure 3G:
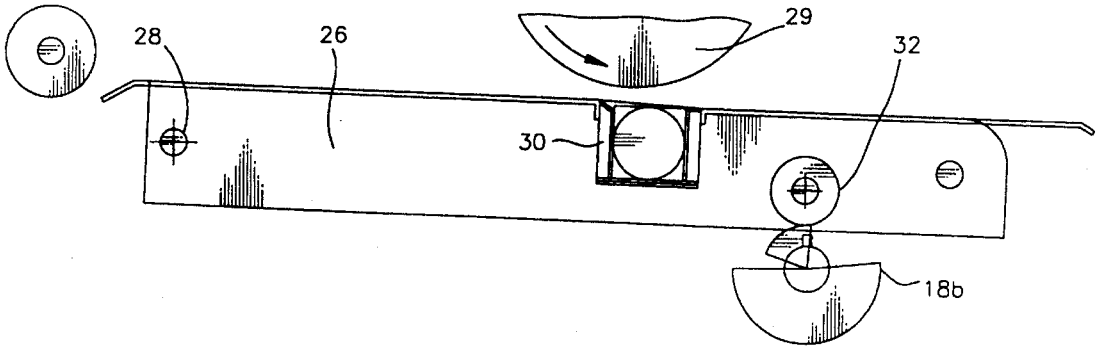
Figure 4G:
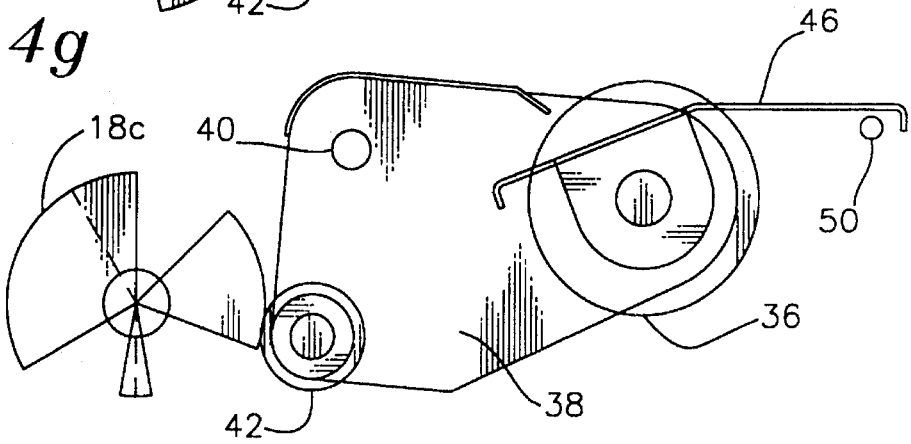

A final 60 degrees of cam rotation places the mechanical components in the state shown in FIGS. 2*h*, 3*g* and 4*g* which is identical to the initial state.

Figures 5A, 5B:
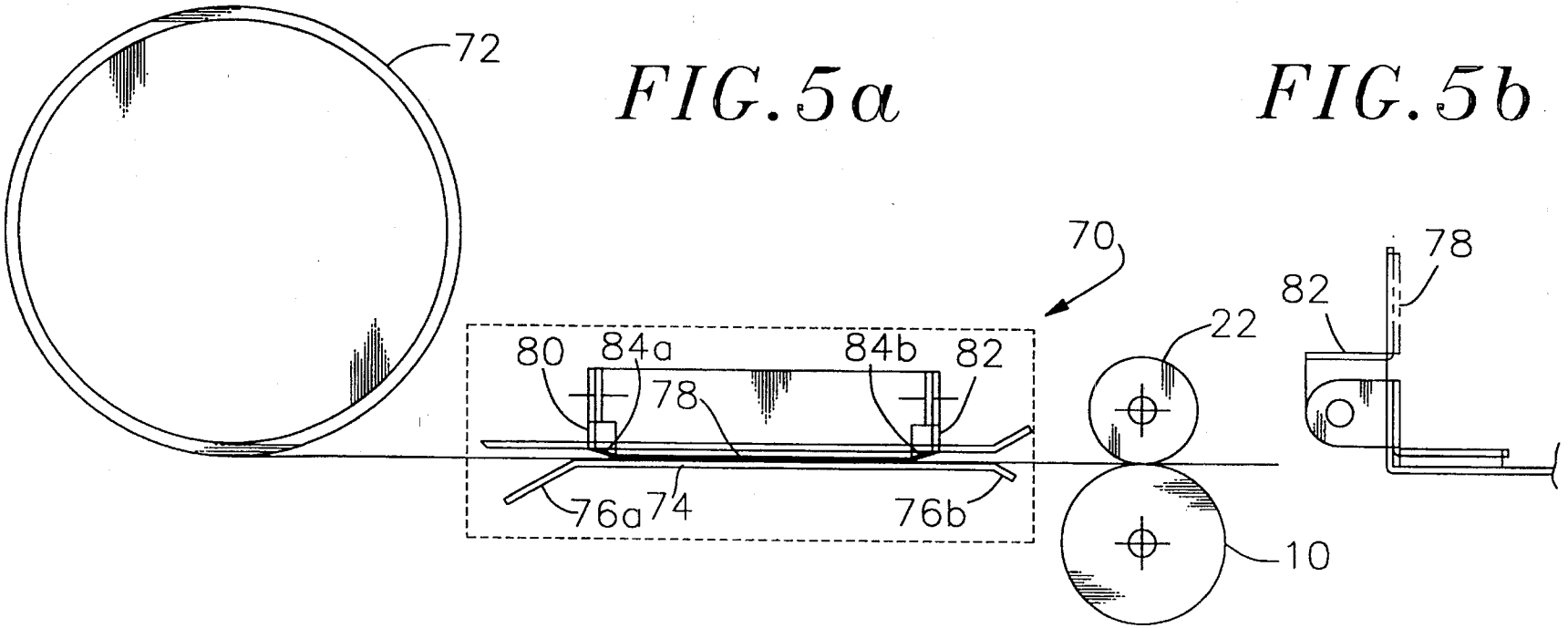
FIG. 5*a* is a side view of the paper anti-skewing mechanism.
FIG. 5*b* is a front view of the paper anti-skewing mechanism with the open or paper loading position shown in phantom.

The present invention also provides additional means to avoid paper skewing in continuous media or form feed applications. As shown in FIGS. 5*a* and 5*b* an anti-skew mechanism generally designated 70 is employed intermediate registration roller 10 (with its companion pressure roller 22) and print media roll 72. The anti-skew mechanism comprises a flat sheet metal plate 74 having downwardly extending lips 76*a* and b at the paper entry and exit points respectively. A second sheet metal plate 78 is attached to two brackets 80 and 82 which are mounted for pivotal rotation from a first open position, shown in FIG. 5*b* in phantom, for aligning paper on the paper guide, to a second closed position wherein the second plate contacts the edge portion of the paper sheet. The second plate is formed with upwardly extending portions 84*a* and b at each end of the plate which provide attachment to the pivotally mounted brackets and, in combination with the material resiliency of the second plate, act as a spring reacting against the paper sheet to provide a downward force on the edge portion of the sheet. A second spring arrangement identical to the first is present on the opposite side of the paper sheet to provide a matching resilient downward pressure on the second edge of the paper. Downward pressure on both edge portions of the sheet maximizes the beam strength of the paper to provide further assurance against skewing.

Figure 6:
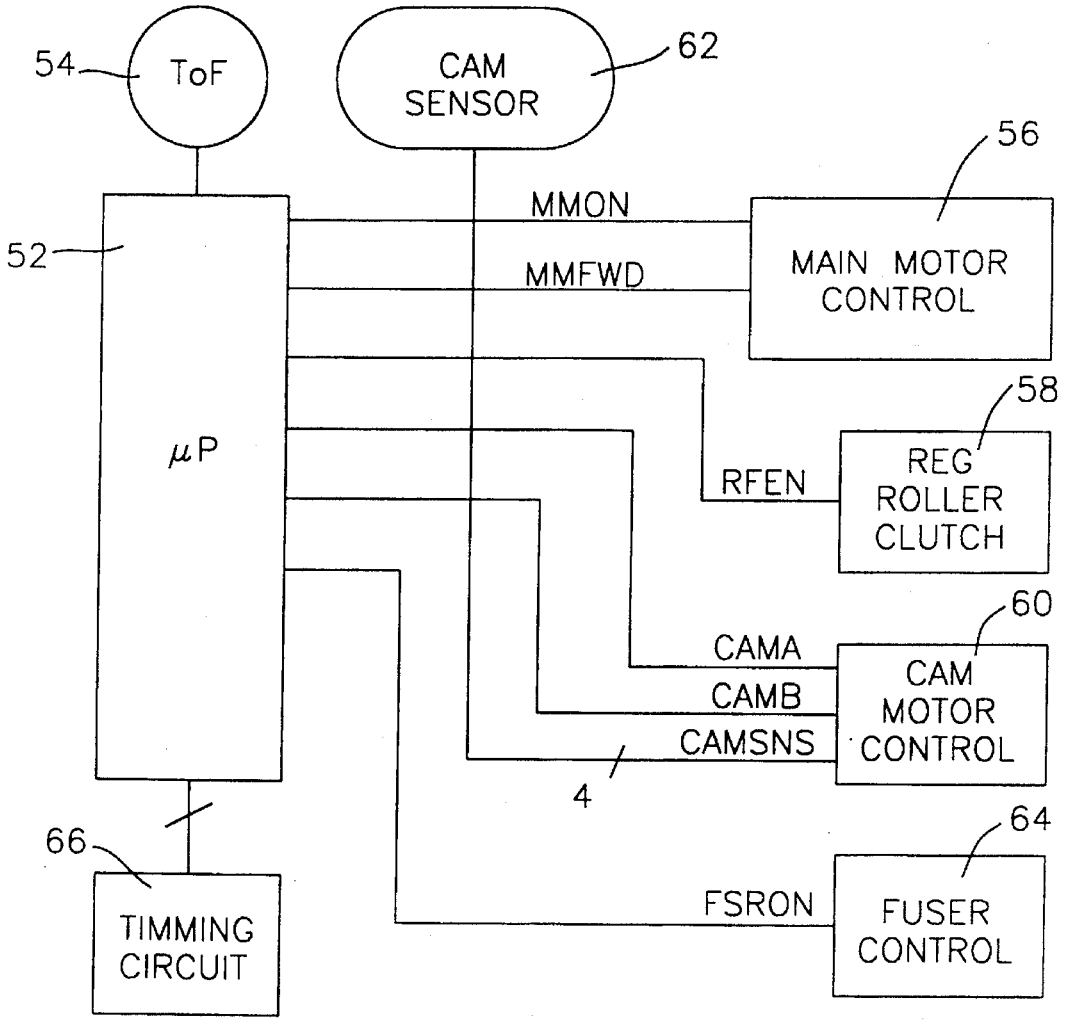
FIG. 6 is a block diagram of the microprocessor based print engine controller.

The positioning and operation of the mechanical portions of the system is accomplished by a controller shown in FIG. 6. The controller incorporates a microprocessor 52 with associated memory for execution of printing instructions. The microprocessor receives input from a top of form (TOF) sensor 54 located in the paper path which identifies the perforations or other indicia of form position in the copy media. A main motor control 56 operates the main motor for rotation of the registration roller and fuser roller. The microprocessor provides a motor on control signal MMON and a motor direction signal MMFWD for forward and reverse control of the motor. The registration roller clutch 58 is controlled by engagement signal RFEN from the microprocessor. Table 1 demonstrates the various operations of the registration roller and fuser roller based on the microprocessor.

Operation of the cam to raise and lower the registration roller paper platen and fuser carriage is accomplished by cam motor control 60 which receives desired position signals CAMA and CAMB from the microprocessor and receives actual position signals CAMSNS from the cam sensor 62. In the embodiment shown in the drawings, the cam sensor comprises three sensor elements which identify cam position relative to the 0° (360° ) position, 90° position and 240° for system control. The cam motor control decodes the two bit desired position transmitted from the microprocessor as shown in Table 2. Based on the actual position provided by the cam sensor, the cam motor control provides a drive output to the cam motor to achieve the desired position. Position 1, with the cam sensor at zero degrees, positions the system with the registration roller engaged to frictionally feed the copy media with the paper platen and fuser carriage in the down or open position as previously described. Position 2, with the cam sensor at 90 degrees, maintains the registration roller in the up position and lifts the paper platen into an up or closed position to engage the print media with the photoconductor as previously described. Position 3, with the cam sensor located at 240 degrees, places the system in a condition with the registration roller open, the paper platen up and the fuser pressure roller up or closed to fuse the print toner to the media with the fuser roller providing the traction feed for the print media. Intermediate positions of the cam during rotation are as previously described.

TABLE 1

| Direction | Roller Engaged | Position | MMON | MMFWD | RFEN |
|---|---|---|---|---|---|
| Off | N/A | N/A | 0 | N/A | N/A |
| Forward | Registration | 1 or 2 | 1 | 1 | 1 |
| Reverse | Registration | 1 | 1 | 0 | 0 |
| Forward | Fuser | 3 | 1 | 1 | N/A |

TABLE 2

| CAMA | CAMB | Position of CAM |
|---|---|---|
| 1 | 1 | 0 Degrees |
| 1 | 0 | 90 Degrees |
| 0 | 1 | 240 Degrees |
| 0 | 0 | Stop (Motor Off) |

As previously described the fuser roller is heated to fuse the print toner to the media. As shown in FIG. 6 a fuser control 64 is employed to apply heat to the fuser based on control signal FSRON from the microprocessor.

The microprocessor employs a timing circuit 66 to properly sequence the control of the main motor control, registration roller clutch, cam motor control and fuser control based on position of the print media and the print commands received.

Figure 7A:
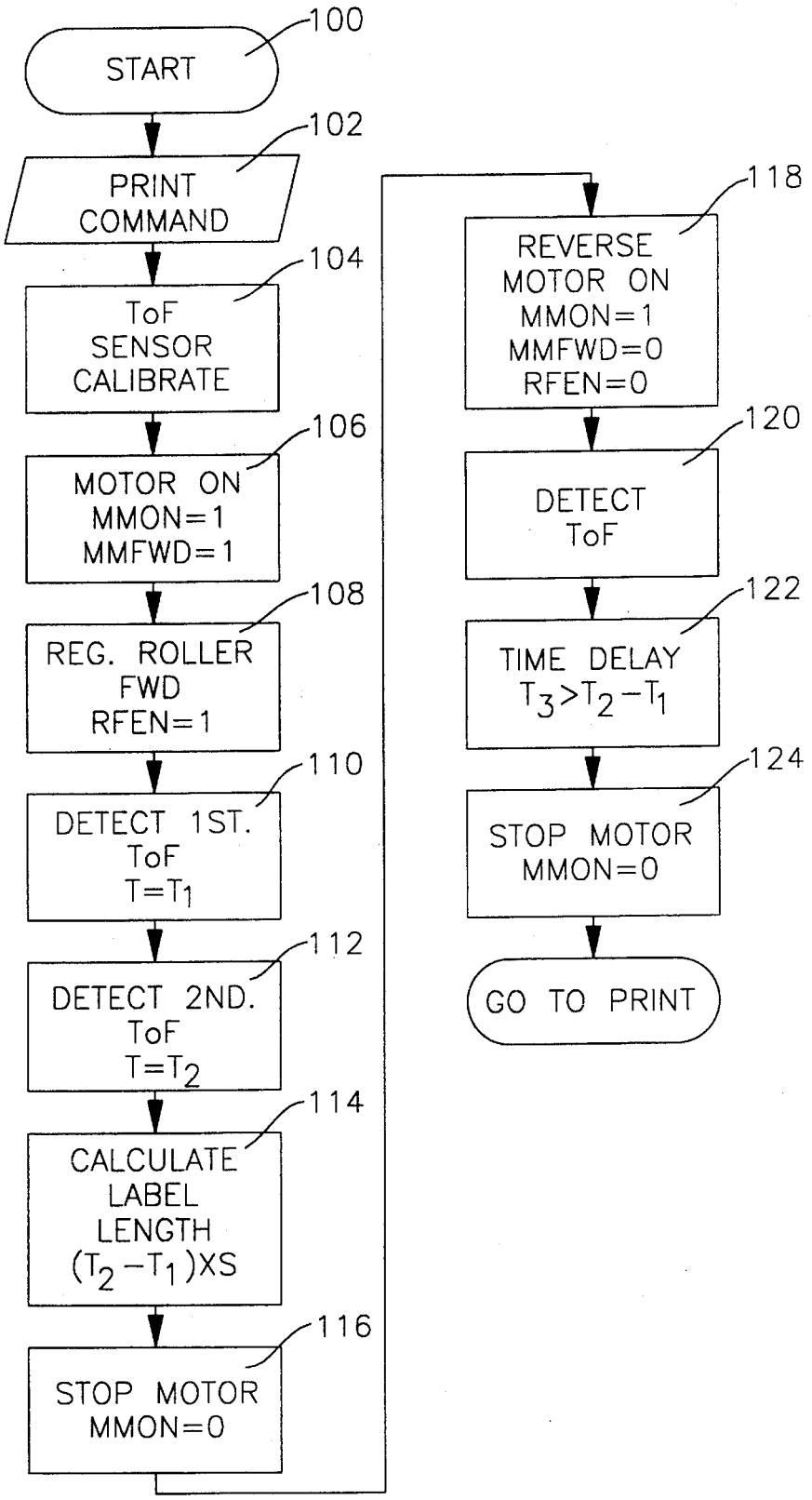
FIG. 7*a* is a flow chart demonstrating the sequence of software control for the print engine controller to determine label length.
Figure 7B:
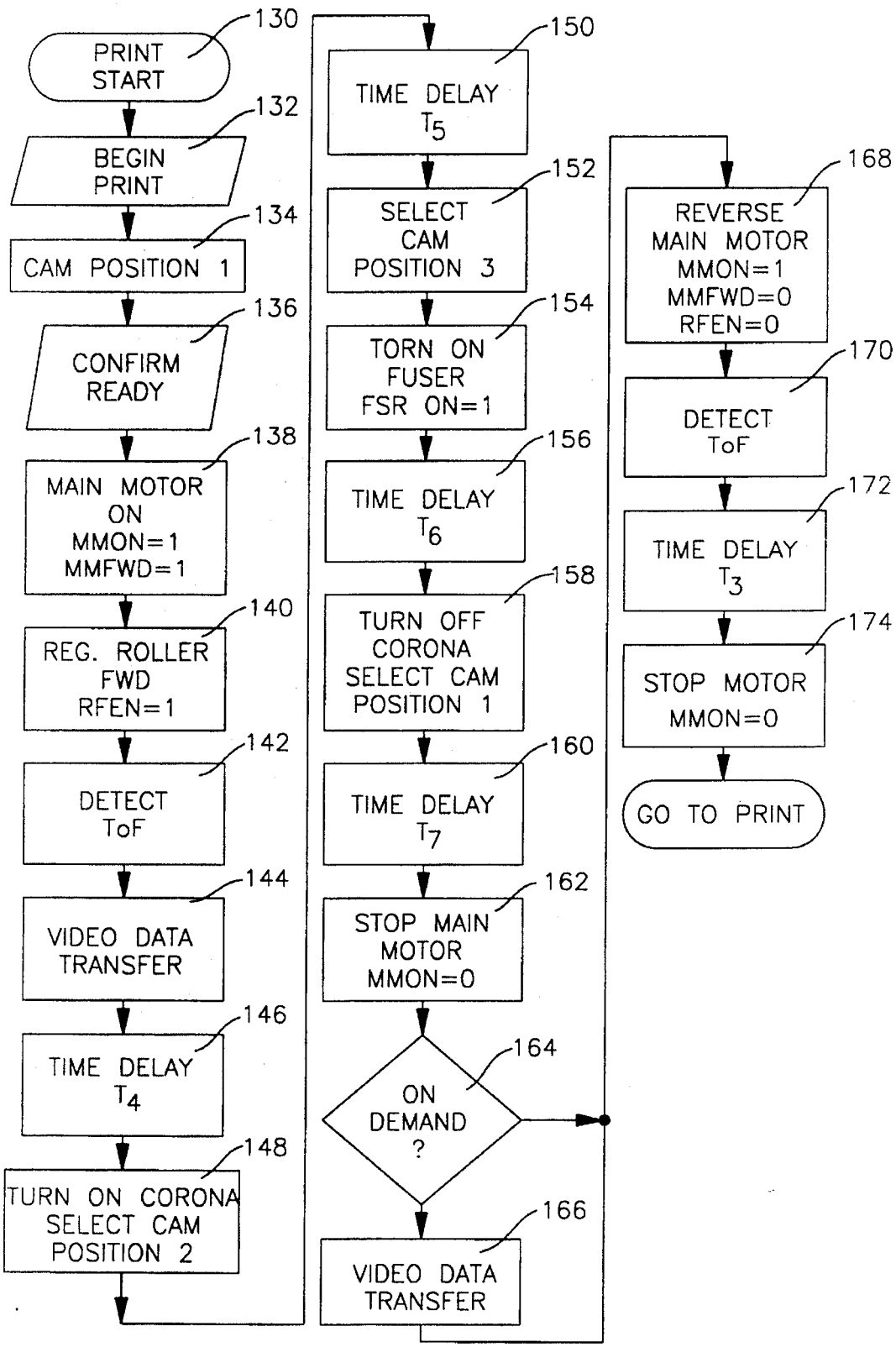
FIG. 7*b* is a flow chart demonstrating the sequence of software control for a printing cycle.

Firmware for the microprocessor operates the system as shown in FIGS. 7*a* and 7*b*. Calibration of the system for timing purposes is accomplished as a portion of a print command. Referring to FIG. 7*a* the system initially resides in a state designated by start block 100. Upon receiving a print command 102, the top of form sensor self calibrates based on the current paper stock in the printer as shown in block 104. The microprocessor then activates the main motor in the forward direction by setting signals MMON and MMFWD to "1". The main motor ramps up to full forward speed and the microprocessor engages the registration roller clutch by setting signal RFEN to 1 in block 108. The print media moves forward through the printer driven by the registration roller in position one as previously described.

The top of form sensor detects a first top of form and the microprocessor flags the timing circuit at time T=T1 in block 110. Upon detection of a second top of form by the TOF sensor the microprocessor flags a second time in the timing circuit, T=T2 in block 112. The microprocessor then calculates the label length based on the speed of the print media through the system times the elapsed time (T2–T1) in block 114. The microprocessor stops the main motor by setting signal MMON to zero in block 116 and re-engages the motor in the reverse direction by setting signals MMON to one, MMFWD to zero and RFEN to zero in block 118. The TOF sensor detects a top of form in block 120 and the microprocessor calculates a time delay T3 which is greater than the label length (calculated based on T2–T1) in block 122. After time delay T3 the microprocessor stops the main motor by setting signal MMON to zero in block 124 and the system is prepared to print.

The print cycle is shown in FIG. 7*b*. The print cycle starts in block 130 and the microprocessor sends a begin print signal to the video source notifying that the print engine is ready, block 132. The microprocessor sets the cam position at position one by setting signals CAMA to one and CAMB to one, block 134. Upon receiving a confirmation signal from the video source, block 136, the microprocessor turns the main motor on in the forward direction, block 138, and when the main motor has ramped up to full forward speed, engages the registration roller clutch in block 140 which causes the print media to begin moving forward. When the TOF sensor detects a top of form in block 142 the microprocessor sends a top of form signal to the video source and video data transfer is made in block 144. In the present system video data is converted through a standard scanner to activate the photoconductor drum to transfer the image as is known in the art.

The microprocessor, upon the TOF detection, initiates a time delay T4 in the timing circuit which is calculated based on the speed of the print media in the system to determine when the front edge of the label is nearing the photoconductor. At the expiration of T4 the microprocessor turns on the corona in the transfer unit and selects cam position two by setting signal CAMA=1 and CAMB=1 in block 148. Time delay T4 is calculated to include the cam motion time from the zero degree to 90 degree position.

As the label passes the photoconductive drum and the transfer unit with the system in position two the image is transferred to the label. After selection of cam position two the microprocessor again waits for a time delay T5, block 150, which is calculated based on the time for the front edge of the label to approach the fuser at which time the microprocessor selects cam position three by setting signals CAMA to zero and CAMB to one, block 152. As previously described with time delay T4, time delay T5 incorporates the cam motion time from 90 degrees to 240 degrees to achieve position three. The microprocessor turns on the fuser in block 154 by setting signal FSRON to one. A time delay T6 sufficient for the entire label to pass through the fuser is obtained by the microprocessor from the timing circuit, block 156, at which time the microprocessor turns off the Corona and selects cam position one, block 158.

A time delay T7 calculated for the label to exit the printer for access by the user is incurred by the microprocessor in block 160 at which time the microprocessor stops the main motor by setting signal MMON to zero block 162.

In this condition the label is presented to the user to be removed if desired.

The microprocessor determines if the printer is in an "on demand" mode block 164 to allow additional video data transfer in block 166. If on demand or at the conclusion of the video data transfer the microprocessor reverses the main motor setting signals MMON to one, MMFWD to zero and RFEN to zero in block 168. Upon detection of top of form block 170 the microprocessor initiates time delay T3 in block 172 to place the label edge appropriately positioned with respect to the TOF sensor for the next print cycle. The microprocessor then stops the motor by setting MMON to zero, block 174, and returns to print start.

In embodiments for short labels, the microprocessor counts the number of labels, m, to pass the detector and the number of labels actually printed, n. Upon completion of the printing cycle, the microprocessor then reverses the label stock for m-n labels. This allows the use of very short labels without wastage.

Batch printing is accomplished in the system by looping in block 156 wherein each label is printed sequentially by the photoconductive drum and transfer unit and fused in the fuser assembly.

Having now fully described the invention in detail as required by the patent statutes those skilled in the art will recognize substitutions and modifications to the embodiment shown herein for specific applications. Such modifications and substitutions are within the scope and intent of the present invention as defined in the following claims.

What is claimed is:

1. A bidirectional paper feed system for laser printers comprising:

a registration roller movable from a first position engaging a print media for frictional drive and a second position releasing said media;

means for selectively engaging the print media intermediate a photoconductive drum and a transfer unit, said engaging means movable from a first position to a second position;

a fuser roller positionable in a first position separated from said print media and a second position engaging said print media for frictional transport of the media;

first means for controllably positioning said registration roller between said first and second position;

second means for controllably positioning said engagement means between said first and second position;

third means for controllably positioning said fuser roller between said first and second positions;

reversible drive means separably connected to drive said registration roller and said fuser roller and responsive to a drive signal; and a controller for controlling said first, second and third positioning means, said controller executing a first state wherein the registration roller is in said first position, said engagement means is in said first position and said fuser roller is in said first position, a second state wherein said registration roller is in said first position, said engagement means is in said second position and said fuser roller is in said first position and a third state wherein said registration roller is in said second position, said engagement means is in said second position and said fuser roller is in said second position, said controller further selectively issuing a forward drive signal in said first, second and third state and selectively issuing a reverse drive signal in said first state.

2. A bidirectional paper feed system as described in claim 1 wherein the registration roller is mounted to a first rocker arm rotating about a pivot point responsive to a first cam roller;

said engagement means comprises a paper platen pivotly mounted at a first end for motion responsive to a second cam roller; and said fuser roller is mounted to a carrier bracket pivotally mounted to a second end of said paper platen, said carrier bracket positionable by a third cam roller;

and wherein said controller includes a cam having a first contoured surface receiving said first cam roller, a second contoured surface receiving said second cam roller, and third cam surface receiving said third cam roller and means for rotating said cam.

3. A bidirectional paper feed system as described in claim 2, further comprising:

a top of form sensor providing a top of form (TOF) signal to said controller;

a cam sensor providing a cam position signal;

and wherein said controller further comprises:

a cam motor for positioning said cam responsive to said cam sensor for said first, second and third state; and a timer responsive to said TOF top of form (TOF) signal, said timer providing a first time for said controller to transition from said first state to said second state and a second time for said controller to transition from said second state to said third state.

4. A bidirectional feed system as described in prior claim 3, wherein said timer further provides a third time to said controller for transition from said third state to said first state.

* * * * *

UNITED STATES PATENT AND TRADEMARK OFFICE

CERTIFICATE OF CORRECTION

PATENT NO. : 5,488,467

DATED : January 30, 1996

INVENTOR(S) : Faustin T. Marentes; Jorge Monasterio

It is certified that error appears in the above-indentified patent and that said Letters Patent is hereby corrected as shown below:

Column 3, line 27, after "controller;" delete "and".
Column 3, line 30, change "length." to -- length; and --.
Column 4, line 42, change "FIG." to -- FIGS. --.
Column 4, line 51, change "FIGS. 2d" to -- FIG. 2d --.
Column 4, line 62, change "copies" to -- copied --.
Column 7, line 50, change "Corona" to -- corona --.
Column 8, lines 31,33, change "position" to -- positions -- (both occurrences).
Column 8, line 58, change "pivotly" to -- pivotally --.
Column 10, line 1, delete "TOF" (first occurrence).

Signed and Sealed this

Eleventh Day of June, 1996

*Attest:*

*Attesting Officer*

BRUCE LEHMAN

*Commissioner of Patents and Trademarks*